US006796683B2

(12) United States Patent
Wood et al.

(10) Patent No.: US 6,796,683 B2
(45) Date of Patent: Sep. 28, 2004

(54) COLOR MIXING APPARATUS FOR THEATRICAL ELLIPSOIDAL SPOTLIGHTS

(75) Inventors: Michael W. Wood, Austin, TX (US); Thomas Shaw Cavness, Austin, TX (US); Glenn Lee Fields, Georgetown, TX (US); Douglas K. Franklin, Austin, TX (US); Mary Alice D. Goewey, Austin, TX (US); Lynwood J. Norrgard, Austin, TX (US); Jesse Dale Trevino, Austin, TX (US)

(73) Assignee: High End Systems, Inc., Austin, TX (US)

( * ) Notice: Subject to any disclaimer, the term of this patent is extended or adjusted under 35 U.S.C. 154(b) by 0 days.

(21) Appl. No.: 10/435,429

(22) Filed: May 9, 2003

(65) Prior Publication Data

US 2003/0206414 A1 Nov. 6, 2003

(51) Int. Cl.[7] ..... F21V 9/08; F21V 13/14

(52) U.S. Cl. ..... 362/281; 362/268; 362/293; 362/323; 362/362

(58) Field of Search ..... 362/293, 280, 362/281, 284, 323, 362, 16, 17, 18, 268; 353/119, 84, 72; 359/889, 891

(56) References Cited

U.S. PATENT DOCUMENTS

| | | | | | |
|---|---|---|---|---|---|
| 3,706,914 | A | | 12/1972 | Van Buren | 315/316 |
| 3,898,643 | A | | 8/1975 | Ealinger | 340/324 |
| 4,095,139 | A | | 6/1978 | Symonds et al. | 315/153 |
| 4,268,735 | A | * | 5/1981 | Iwakiri | 200/314 |
| 4,271,429 | A | * | 6/1981 | Herbst | 348/104 |
| 4,697,227 | A | | 9/1987 | Callahan | 362/233 |
| 5,126,886 | A | | 6/1992 | Richardson et al. | 359/888 |
| 5,882,107 | A | * | 3/1999 | Bornhorst et al. | 362/281 |
| 5,915,828 | A | * | 6/1999 | Buckley | 362/293 |
| 6,113,252 | A | * | 9/2000 | Arlitt et al. | 362/365 |
| 6,474,837 | B1 | * | 11/2002 | Belliveau | 362/231 |

OTHER PUBLICATIONS

Electronic Theatre Controls, Inc.; *Source Four™ Assembly Guide*; Copyright 2001: (20 p.).
Great American Market 5×4; (1 p.) : Available at www.ga-monline.com.

* cited by examiner

*Primary Examiner*—Alan Cariaso
*Assistant Examiner*—Mark Tsidulko
(74) *Attorney, Agent, or Firm*—Conley Rose P.C.

(57) ABSTRACT

A color changing apparatus adapted to be installed between the reflector assembly and front barrel assembly of a theatrical ellipsoidal spotlight. The color changing apparatus includes a housing for connecting to the spotlight components. Contained within the housing are a plurality of color filters, preferably dichroic color filters, serially arranged perpendicular to the light path. The color filters may include constant or variable density patterns of any desirable color and are transported into the light path to effect a change in lighting conditions. The color changing apparatus is also preferably equipped with a control system enabling remote actuation and control of the system.

35 Claims, 9 Drawing Sheets

COLOR MIXING APPARATUS FOR THEATRICAL ELLIPSOIDAL SPOTLIGHTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The embodiments of the present invention generally relate to theatrical lighting systems that are digitally controlled and to the theatrical ellipsoidal spotlights used therein. More specifically, the embodiments of the present invention relate to color changing apparatus for theatrical ellipsoidal spotlights.

Lighting systems are typically formed by interconnecting, via a communications system, a plurality of lighting fixtures and providing for operator control of the plurality of lighting fixtures from a central controller. Such lighting systems may contain theatrical ellipsoidal spotlights. Applications and events in which theatrical ellipsoidal spotlights are used to great advantage include showrooms, television lighting, stage lighting, architectural lighting, live concerts, and theme parks.

Prior to the advent of relatively small commercial digital computers, remote control of light fixtures from a central controller was done with either a high voltage or low voltage current; see, e.g., U.S. Pat. No. 3,706,914, issued Dec. 19, 1972 to Van Buren, and U.S. Pat. No. 3,898,643, issued Aug. 5, 1975 to Ettlinger, both of which are incorporated by reference herein for all purposes. With the widespread use of computers, digital serial communication was widely adopted as a way to achieve remote control; see, e.g., U.S. Pat. No. 4,095,139, issued Jun. 13, 1978 to Symonds et al., and U.S. Pat. No. 4,697,227, issued Sept. 29, 1987 to Callahan, both of which are incorporated by reference herein for all purposes. In 1986, the United States Institute of Theatre Technology ("USITT") developed a digital communications system protocol for theatrical lighting known as DMX.

A theatrical lighting system may include a central controller that uses the DMX protocol to communicate over a communication system to a plurality of dimming units. Each dimming unit may have a plurality of controlled outputs with each output being electrically connected to the lamp of an ellipsoidal spotlight. A single dimming unit may control the intensity of 4 or more of the ellipsoidal spotlights. For some shows, as many as 100 ellipsoidal spotlights connected to 25 dimming units may have their intensity individually controlled by an operator of the central controller. The operator of the central controller inputs address and command information that is sent over the communications system to individually control the intensity of each of the plurality of ellipsoidal spotlights.

For many theatrical shows, colored lighting is required to provide a dynamic effect on the stage. Most ellipsoidal spotlights have a mounting location for a color filter located in front of the final lens. The mounting location is commonly referred to as a gel holder. The term gel comes from the gelatin substrate sometimes used to manufacture color filters. Gels today may be constructed of polycarbonate flexible sheeting to help resist the high temperatures associated with the light energy projected from the ellipsoidal spotlight. A sheet of colored gel may be held in a frame, which may be located or fixed relative to the gel holder of the ellipsoidal spotlight. Even though the gels may be constructed of polycarbonate, the light energy from the colors not transmitted by the gels is absorbed by the gels, thus elevating the temperature of the gel. Therefore, the gels must be changed frequently by show maintenance personnel because the gel color fades or the sheeting distorts due to the high heat absorbed by the gel. The labor costs to change the gels frequently for large shows can be quite high.

Color scrolling devices have been manufactured in order to allow remote controlled selection of a desired gel color for a particular spotlight by an operator of the central controller. The color scroller device often includes one or more scrolling rolls of gel sheeting, where each of the rolls of gel can be remotely controlled to scroll through the length of gel sheeting. One exemplary gel scrolling system using multiple scrolls or variable saturation is disclosed in U.S. Pat. No. 5,126,886 to Richardson, et al and is incorporated by reference herein for all purposes.

The gel scrolling system disclosed by Richardson is an improvement over the prior art color changing gel scrollers because it uses multiple gel scrolls each of a different color and each with variable saturation. Thus, the operator of the central controller may gradually change a first color to a second color by varying the saturation of the multiple gel scrolls in front of the ellipsoidal spotlight. The gel used in the Richardson gel scroller still has the disadvantage of fading and distorting over time and maintenance is again required to apply new gel material to the scrolls.

One popular theatrical ellipsoidal spotlight model is the Source Four™ as manufactured by Electronic Theatre Controls of Middleton, Wis. The Source Four™ ellipsoidal spotlight has a modular construction so that various lens systems can easily be applied to suit the application of a particular show. The Source Four™ ellipsoidal spotlight is constructed of a reflector housing assembly and front barrel assembly that may include a lens tube assembly. These assemblies are easily disassembled and reassembled in that the reflector assembly can be disconnected from the front barrel assembly and the lens tube assembly can be removed from the front barrel assembly.

Therefore, it is possible to produce a modular, housing-based optical system that can be designed to mate with the reflector assembly and the front barrel assembly of the Source Four™ spotlight. At least one company has built a modular optical apparatus that mates the reflector assembly with the front barrel assembly of an ellipsoidal spotlight. The Great American Market Company of Hollywood, Calif. has produced a product called an SX4© that may be used to automatically change or scroll patterns in the light path and is installed between the reflector assembly and the front barrel assembly of a Source Four™ ellipsoidal spotlight.

There is need for an improved color changing apparatus to be used in conjunction with a conventional theatrical ellipsoidal spotlight and that does not possess the drawback of incorporating gel color filters that fade or distort and yet can produce a broad range of varying color.

SUMMARY OF THE PREFERRED EMBODIMENTS

The embodiments of the present invention include a color changing apparatus adapted to be installed between the reflector assembly and front barrel assembly of a theatrical ellipsoidal spotlight. The color changing apparatus includes a housing for connecting to the spotlight components. Contained within the housing are a plurality of color filters, preferably dichroic color filters, serially arranged perpendicular to the light path. The color filters may include constant or variable density patterns of any desirable color and are transported into the light path to effect a change in lighting conditions. The color changing apparatus is also preferably equipped with a control system enabling remote actuation and control of the system.

One embodiment includes a color changing apparatus for a theatrical ellipsoidal spotlight having a reflector housing and a front barrel housing. The color changing apparatus has a housing with first and second sides, a first fastening system, for releasably joining the first side of the housing to the reflector housing, and a second fastening system, for releasably joining the second side of the housing to the front barrel housing. A plurality of color filters, preferably dichroic color filters, is contained at least in part within the housing. In certain embodiments, the color filters are serially arranged, include filters that are cyan, magenta, and yellow, and may be transported by an actuator to be into or out of a light path that is created by the reflector of the ellipsoidal spotlight.

In another embodiment, the color changing apparatus for a theatrical ellipsoidal spotlight includes a housing joining a reflector housing and a front barrel housing of the theatrical ellipsoidal spotlight. Light is projected along a path from the reflector, through said housing and through the front barrel. A plurality of dichroic color filters are disposed within the housing and at least one of said plurality of dichroic filters has a variable density pattern. The apparatus also has a control system including a plurality of actuators and a communications port, wherein the control system is adapted to adjust the position of the plurality of dichroic filters. The communications port receives a command and the control system acts on the command to control the actuators so as to transport selected dichroic filters into the light path. The communications port may be connected to at least one external connector adapted to relay both power and communications.

In another alternative embodiment, a theatrical lighting system includes two theatrical ellipsoidal spotlights, each containing a pattern gate, a color changing apparatus, a reflector housing, and a front barrel housing. The color changing apparatus are conjoined with reflector housings and the front barrel housings of the ellipsoidal spotlights. The color changing apparatus comprise a plurality of dichroic filters serially arranged between the reflector housing and the front barrel housing. Each color changing apparatus includes a control system connected to the first color changing apparatus by a communications port adapted to receive a command signal to cause the plurality of dichroic filters to be transported into a light path created by the reflector housing of the theatrical spotlight.

Another embodiment includes a method for projecting light on a surface by providing a plurality of color filters disposed within a housing, installing the housing in a theatrical ellipsoidal spotlight comprising a pattern gate, between a reflector housing and a front barrel housing, to form a light path that runs from the reflector, through the housing, and into the front barrel, and projecting light from the reflector along the light path and onto the surface.

An alternative embodiment includes a method for controlling light projected onto a surface by providing a plurality of color filters disposed within a housing that is installed between a reflector housing and a front barrel housing of a theatrical ellipsoidal spotlight establishing a light path that runs from the reflector, through the housing, and into the front barrel, connecting a plurality of actuators to the plurality of color filters, wherein the plurality of actuators are adapted to transport each of said plurality of color filters into and out of the light path, and transmitting a command to the control system causing one of the plurality of actuators to transport one of the plurality of color filters into the light path.

Thus, the present invention comprises a combination of features and advantages that enable it to overcome various problems of prior art theatrical ellipsoidal spotlights. The various characteristics described above, as well as other features, objects, and advantages, will be readily apparent to those skilled in the art upon reading the following detailed description of the preferred embodiments of the invention, and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1A:
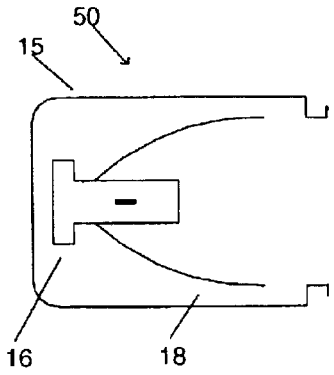
FIG 1A Prior Art
FIGS. 1A–1C are schematic representations of a prior art theatrical ellipsoidal spotlight.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

Figure 1B:
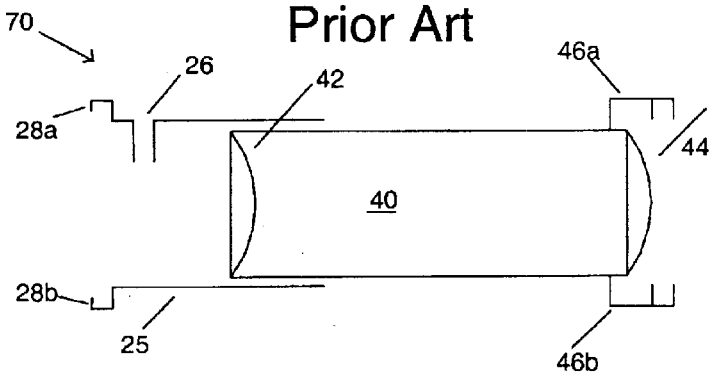
FIG 1B Prior Art
Figure 1C:
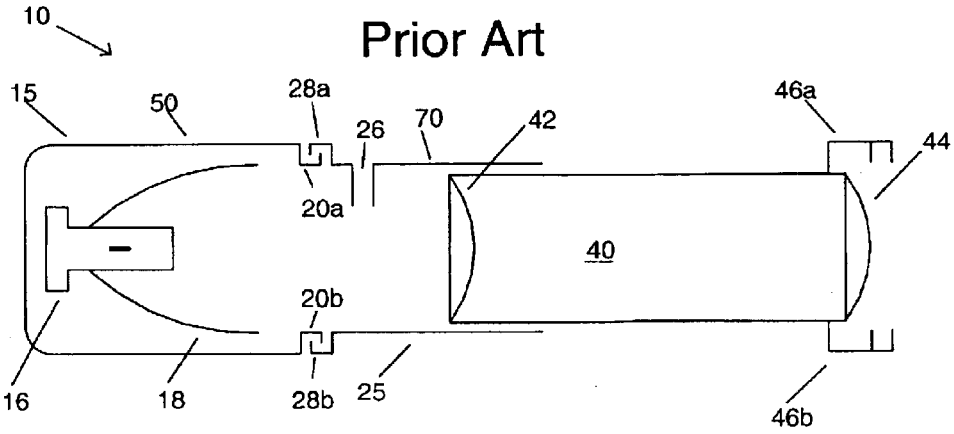
FIG 1C Prior Art

FIGS. 1A–1C show the construction of a prior art theatrical ellipsoidal spotlight 10. Referring first to FIG. 1C, The ellipsoidal spotlight 10 is comprised of two separate housings shown as the reflector assembly housing 50 and the front barrel assembly housing 70. The reflector assembly housing 50 will be referred to herein as the reflector housing for simplification. The front barrel assembly housing 70 will be referred to herein as the front barrel housing for simplification.

Referring now to FIG. 1A, the reflector housing 50 is comprised of the housing 15, the reflector 18, the lamp 16, and mating flanges 20*a* and 20*b*. The lamp 16 may also be contained in part within a lamp assembly that is fixed to the reflector housing but not shown for simplification. Referring now to FIG. 1B, the front barrel housing 70 is comprised of the housing 25, the mating flanges 28*a* and 28*b*, and the pattern gate 26. The lens barrel assembly 40 may also be installed as part of the front barrel housing 70. The lens barrel assembly 40 consists of input lens 42, output lens 44, and a gel frame holder flanges 46*a* and 46*b*. As shown in FIG. 1C, the ellipsoidal spotlight 10 shows that the flanges 20*a* and 20*b* of the reflector housing 50 are conjoined with flanges 28*a* and 28*b* of the front barrel housing 70 to form the assembled prior art ellipsoidal spotlight 10.

Figure 1D:
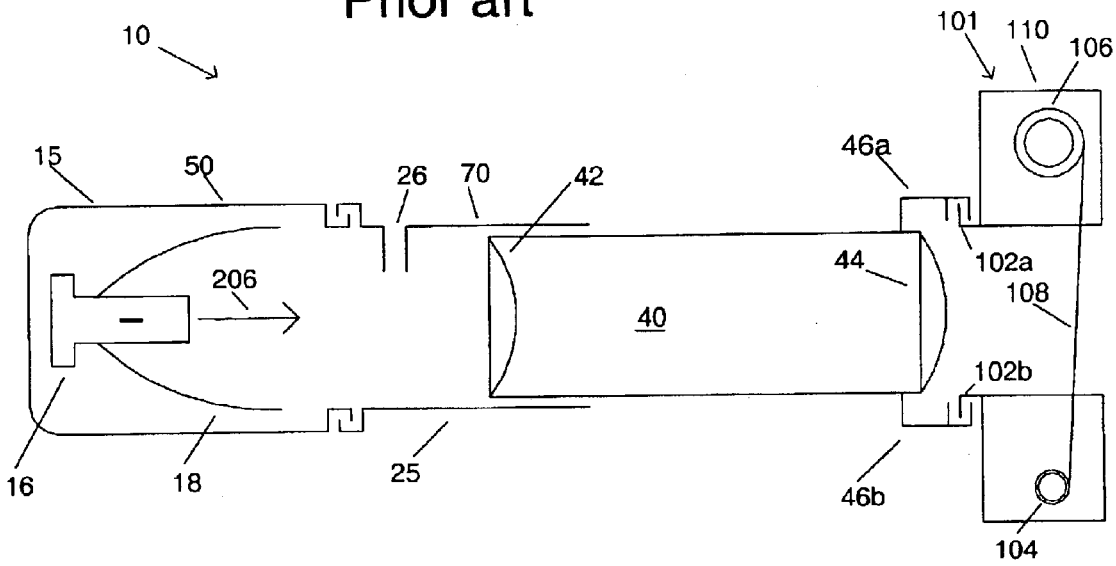
FIG 1D Prior art
FIG. 1D is a schematic representation of the spotlight of FIGS. 1A–1C equipped with a prior art color changing apparatus.

FIG. 1D shows ellipsoidal spotlight 10 including a scrolling color changing apparatus 101 of the prior art. Apparatus 101 is shown as a gel scroller fixed to the gel frame holder flanges 46*a* and 46*b* that are attached to the lens barrel assembly 40. The gel scroller 101 is comprised of a housing 110, a gel feed roller 106, a linear roll of gel material 108 that is positioned, in part, across the output lens 44, and a take up roller 104. The gel scroller 101 also comprises the mating flanges 102*a* and 102*b* that are shown conjoined with gel frame holder flanges 46*a* and 46*b* so that the gel scroller 101 is fixed to the theatrical ellipsoidal spotlight 10.

In operation, electrical power is applied to the lamp 16 and the lamp emits white light. The white light from the lamp 16 is collected by the reflector 18 and directed along a path towards the input lens 42 in the direction of arrow 206. The white light is collected by input lens 42 and directed to output lens 44 where it is directed through the colored gel material 108, thus producing colored light that is projected upon a stage (not shown). The pattern gate 26 is shown without a pattern installed for simplification but it is known within the prior art to insert stenciled images or slides into the pattern gate 26. These slides are inserted from the exterior of the front barrel housing 70 and focused upon by the input lens 42 to be projected by the output lens 44 as an image onto the stage (not shown). The gel scroller 101 is electrically powered to cause the take-up roller 104 to take up the linear gel roll of material 108 from the feed roller 106 by a mechanical system of actuator motors (not shown). The linear gel material 108 may be comprised of different colored sections of gel or different saturations of color throughout the linear roll. The action of the rollers 104 and 106 may be remotely controlled from a central controller, as known in the prior art.

Figure 2:
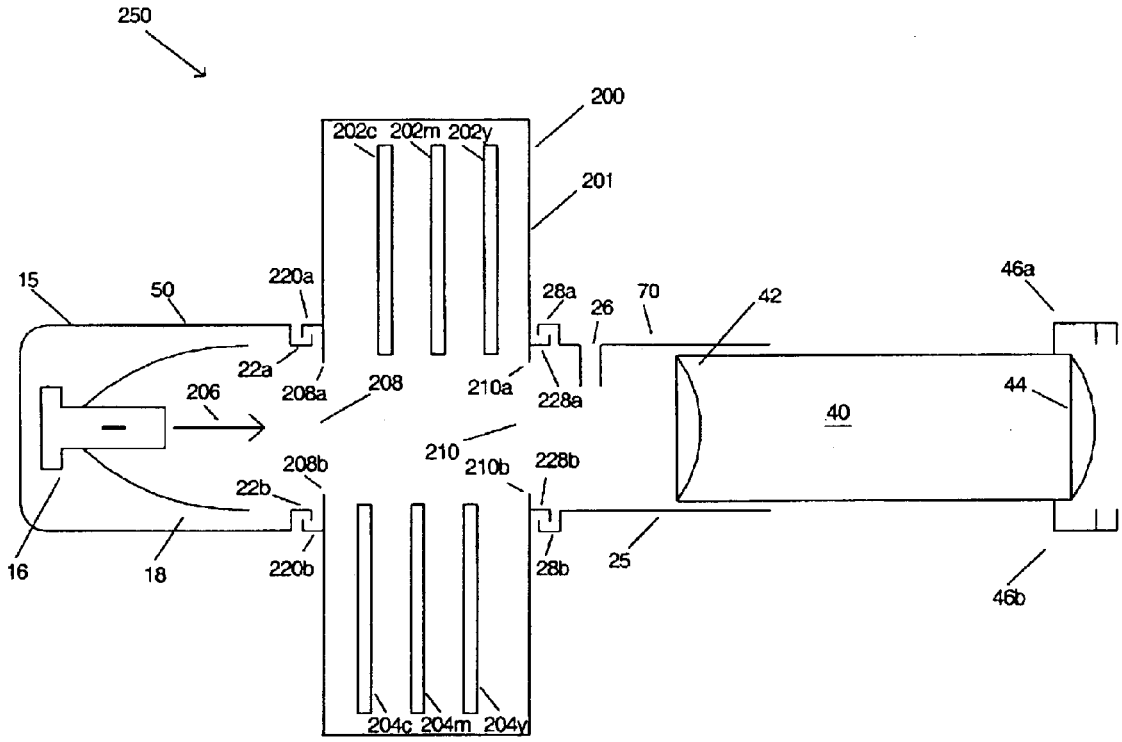
FIG. 2 is a schematic representation of one embodiment of a color changing apparatus constructed in accordance with the present invention conjoined with the ellipsoidal spotlight components of FIGS. 1A–1C.

FIG. 2 shows one embodiment of a color changing apparatus 200 joined to the reflector housing 50 and the front barrel housing 70 from FIGS. 1A–1C to produce an improved ellipsoidal spotlight 250. The components shown as 15, 16, 18, 22*a* and 22*b* comprising the reflector housing 50 are the same as those shown comprising the reflector housing 50 of FIG. 1A. The components shown as 25, 28*a*, 28*b*, 26, 40, 42, 44, 46*a* and 46*b* of the front barrel housing 70 are the same as those shown comprising the front barrel housing 70 of FIG. 1B.

The color changing apparatus 200 is comprised of a serially arranged plurality of color filters 202*c*, 204*c*, 202*m*, 204*m*, 202*y* and 204*y*. The color filters 202*c*, 204*c*, 202*m*, 204*m*, 202*y* and 204*y* are preferably rectangular dichroic color filters. Dichroic color filters do not fade or distort like the gel filters used in conventional color scrollers. By way of example, the color filters 202*c* and 204*c* are a pair of cyan color filters, the color filters 202*m* and 204*m* are a pair of magenta color filters, and the color filters 202*y* and 204*y* are a pair of yellow color filters. The color filters 202*c*, 204*c*, 202*m*, 204*m*, 202*y* and 204*y* may preferably have a variable density pattern applied that allows for variable saturation of color as the color filters are translated to intercept the light path 206 that is created by the light from the lamp 16 cooperating with the reflector 18.

The color changing apparatus 200 also comprises a housing 201 in which the color filters 202*c*, 204*c*, 202*m*, 204*m*, 202*y* and 204*y* are located. Housing 201 has a set of input mating flanges 220*a* and 220*b* that are disposed around the light input aperture 208, the extremities of which are indicated by points 208*a* and 208*b*. The input mating flanges 220*a* and 220*b* of the color changing apparatus 200, are designed to mate with the mating flanges 22*a* and 22*b* of the reflector housing 50. When the input mating flanges 220*a* and 220*b* are mated with mating flanges 22*a* and 22*b* of the reflector housing 50, the color changing apparatus 200 is conjoined with the reflector housing 50. While only two input mating flanges are shown fixed to the housing 201 of the color changing apparatus 200, more than two mating flanges may be used.

A set of output mating flanges 228*a* and 228*b* are shown fixed to housing 201 of the color changing apparatus 200 of FIG. 2. The output mating flanges 228*a* and 228*b* are designed to mate with the mating flanges 28*a* and 28*b* of the housing 25 of the front barrel housing 70. When the input mating flanges 228*a* and 228*b* are mated with mating flanges 28*a* and 28*b* of the front barrel housing 70, the color changing apparatus 200 is conjoined with the front barrel housing 70. While only two input mating flanges are shown fixed to the housing 201 of the color changing apparatus 200, more than two mating flanges may be used. Although mating flanges are shown for conjoining the reflector housing 50 to the color changing apparatus 200 and conjoining the color changing apparatus 200 to the front barrel housing 70, other types of fastening systems may be used.

The light generated by the reflector housing 50 along the light path 206 passes through the light input aperture 208 of the color changing apparatus 200 and passes without intersecting the color filters 202*c*, 204*c*, 202*m*, 204*m*, 202*y* and 204*y*. Next, the light passes through the light output aperture 210 that has its extremities indicated by 210*a* and 210*b*. The light exiting the output aperture 201 is gathered by the input lens 42 and next heads in the direction of output lens 44 where it is projected upon the stage (not shown).

Figure 3A:
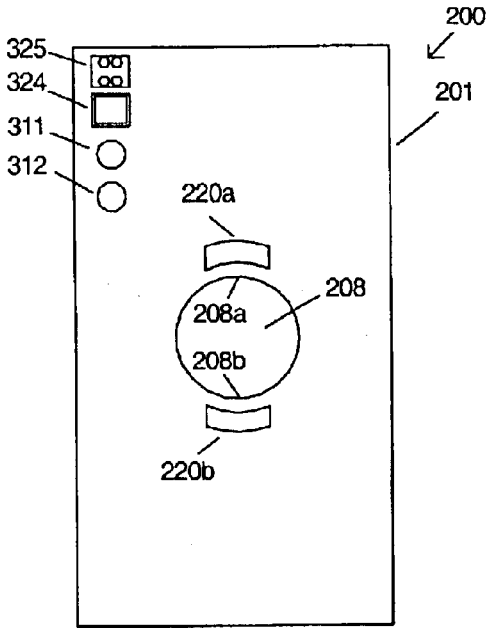
FIG. 3A is a front external schematic view of the color changing apparatus of FIG. 2.

FIG. 3A shows a front external view of the color changing apparatus 200 of FIG. 2. The light input aperture 208 as indicated by the extremities 208*a* and 208*b* is shown. The light input aperture 208 is preferably a round aperture. Two input mating flanges 220*a* and 220*b* are shown. A power and communications input and output connectors are shown as 311 and 312 respectively. A digital display 324 and an input switch array 325 are shown. The digital display 324 and the input switch array 325 can be used to set an operating address for the color changing apparatus 200.

Figure 3B:
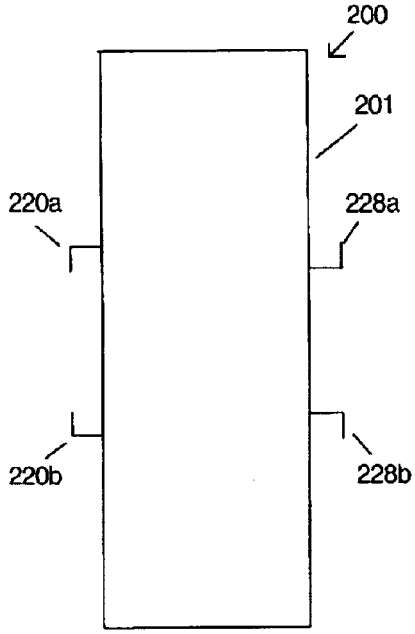
FIG. 3B is a side external schematic view of the color changing apparatus of FIG. 2.

FIG. 3B shows a side external view of the color changing apparatus 200 of FIG. 2. The input mating flanges 220*a* and 220*b* fixed to the housing 201 are the same as those shown in FIG. 2. The output mating flanges 228*a* and 228*b* fixed to the housing 201 are the same shown in FIG. 2.

Figure 3C:
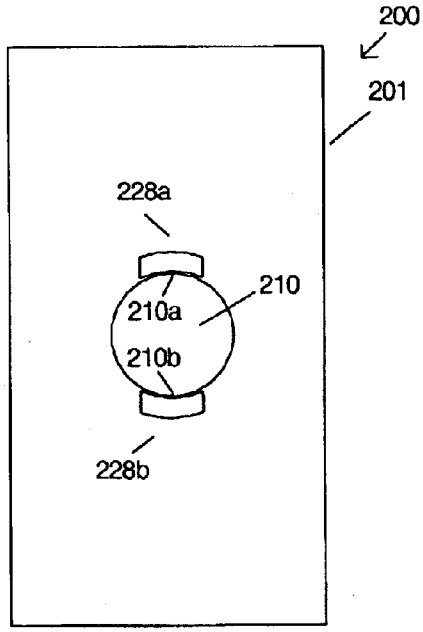
FIG. 3C is a rear external schematic view of the color changing apparatus of FIG. 2.

FIG. 3C shows a rear external view of the color changing apparatus 200 of FIG. 2. The light output aperture 210 as indicated by the extremities 210*a* and 210*b* is shown. The light output aperture 210 is preferably a round aperture. Two output mating flanges 228*a* and 228*b* are shown and are the same as those shown in FIG. 2.

Figure 4A:
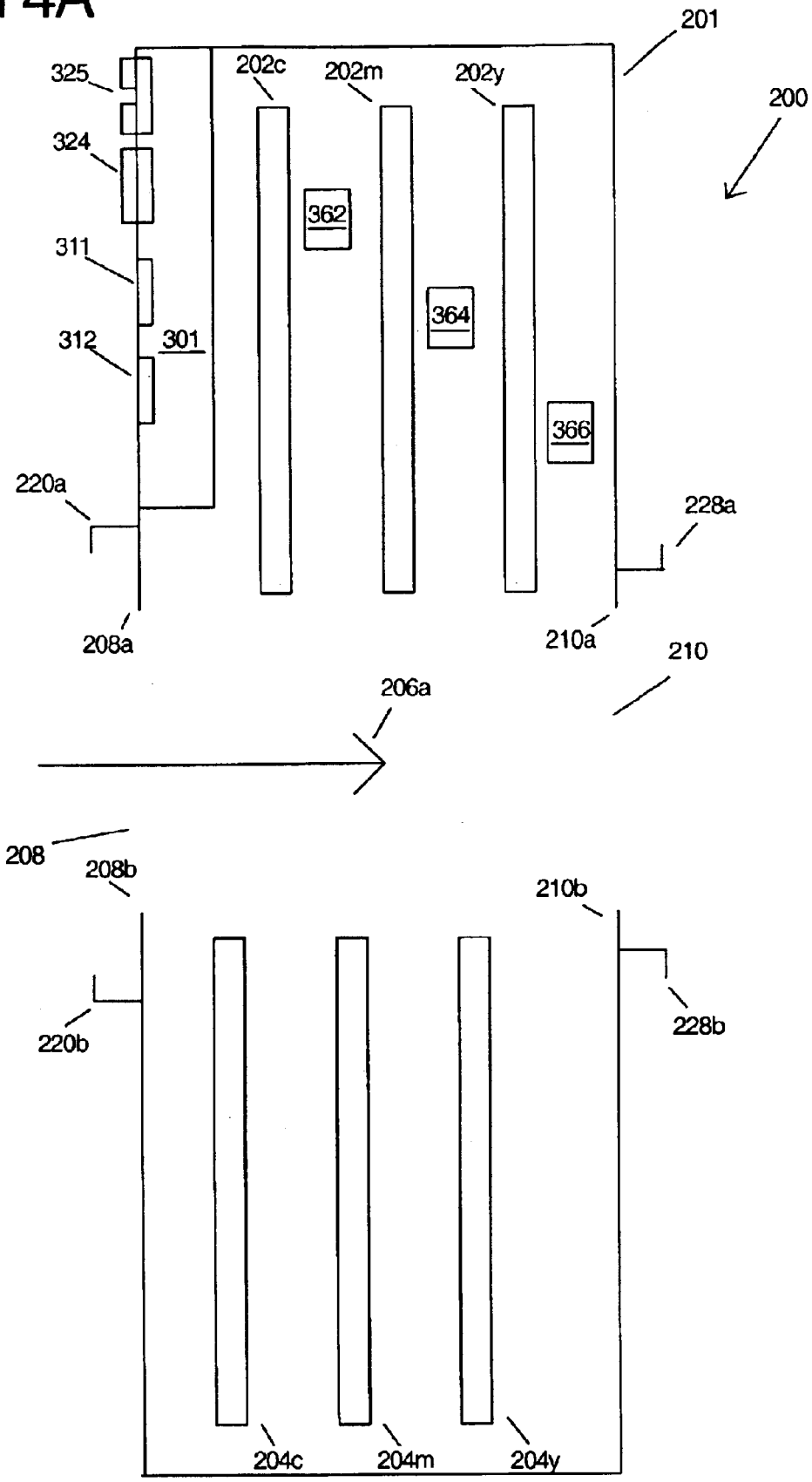
FIG. 4A is an internal schematic view of the color changing apparatus of FIG. 2, shown in a first state.

FIG. 4A shows a more detailed side view of the color changing apparatus 200 of FIG. 2 in a first state. Components 202*c*, 204*c*, 202*m*, 204*m*, 202*y*, 204*y*, 220*a*, 220*b*, 208, 208*a*, 208*b*, 228*a*, 228*b*, 210, 210*a*, 210*b* and 201 are the same shown in FIG. 2. An electronic control system 301 is shown. Components 311, 312, 324 and 325 are the same as those shown in FIG. 3A. Three motor actuators 362, 364 and 366 are shown. The motor actuator 362 is arranged to transport the cyan color filter pair 202*c* and 204*c* gradually into and out of the light path as shown by arrow 206*a* that passes through the input aperture 208 to the output aperture 210. The motor actuator 364 is arranged to transport the magenta color filter pair 202*m* and 204*m* gradually into and out of the light path that passes through the input aperture 208 to the output aperture 210. The motor actuator 366 is arranged to transport the yellow color filter pair 202*y* and 204*y* gradually into and out of the light path that passes through the input aperture 208 to the output aperture 210. The motor actuators 362, 364 and 366 are arranged to transport their pairs of color filters gradually into and out of the light by any suitable mechanical means such as belts or gears. The motors actuators may be DC servo motors, stepper motors or other electronic actuators. It is preferred that the actuators are stepper motors.

Figure 4B:
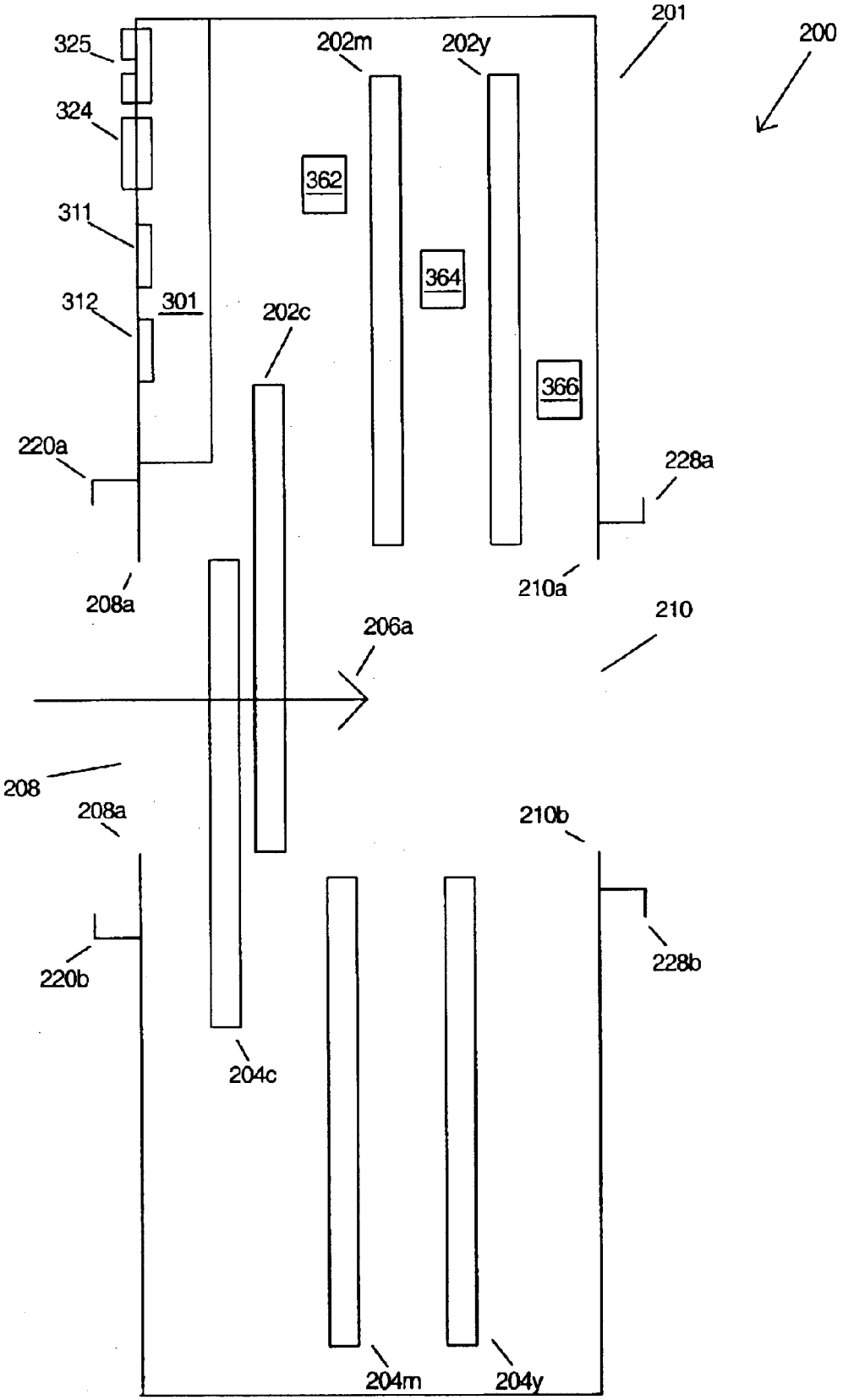
FIG. 4B is an internal schematic view of the color changing apparatus of FIG. 2, shown in a second state.

FIG. 4B shows a more detailed side view of the color changing apparatus 200 of FIG. 2 in a second state. Components 202*c*, 204*c*, 202*m*, 204*m*, 202*y*, 204*y*, 220*a*, 220*b*, 208, 208*a*, 208*b*, 228*a*, 228*b*, 210, 210*a*, 210*b* and 201 are the same shown in FIG. 2. An electronic control system 301 is shown. Components 311, 312, 324 and 325 are the same as those shown in FIG. 3A. Three motor actuators 362, 364 and 366 are shown. FIG. 4B shows that the motor actuator 362 has transported the cyan color filter pair 202*c* and 202*y* into the light path. The light path is shown by arrow 206*a*.

Figure 5:
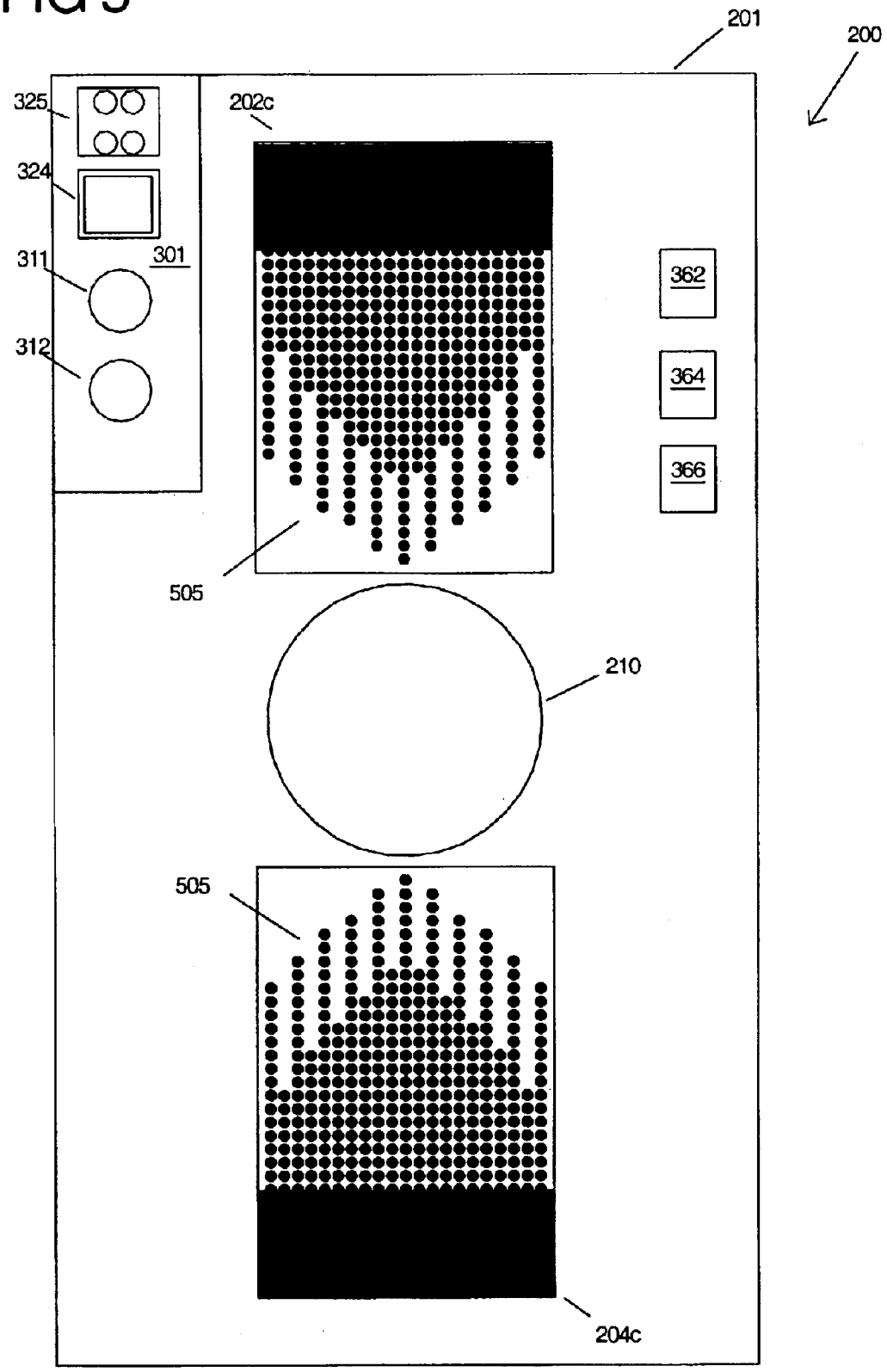
FIG. 5 is a front internal schematic view of the color changing apparatus of FIG. 2.

FIG. 5 shows a more detailed front view of the color changing apparatus 200 of FIG. 2 in a first state. Components 202*c*, 204*c*, 210 and 201 are the same as those shown in FIG. 2. An electronic control system 301 is shown. Components 311, 312, 324 and 325 are the same as those shown in FIG. 3A. Three motor actuators 362, 364 and 366 are shown. The color filters 202*c* and 204*c* are shown with a variable density color pattern 505 applied to both filters 202*c* and 204*c*. The color pattern 505 is applied to the other color filters 202*m*, 204*m*, 202*y* and 204*y* (not shown in FIG. 5 for simplification) that comprise the color changing apparatus 200. The variable density color pattern 505 may be any color pattern applied to the color filters 202*c*, 204*c*, 202*m*, 204*m*, 202*y* and 204*y* that allows for variable saturation of the light path as the color filters are gradually inserted into the light path. The variable density color pattern 505 may be applied to the color filters by silk screen, laser ablation or chemical etching. The creation of variable density color patterns is known in the prior art. The color pattern 505 may be the same pattern applied to the color filters 202*c*, 204*c*, 202*m*, 204*m*, 202*y*, and 204*y* or the pattern may be different for each color in order to optimize how much of the color is applied to the light path by the actuators 362, 362 or 366.

Figure 6:
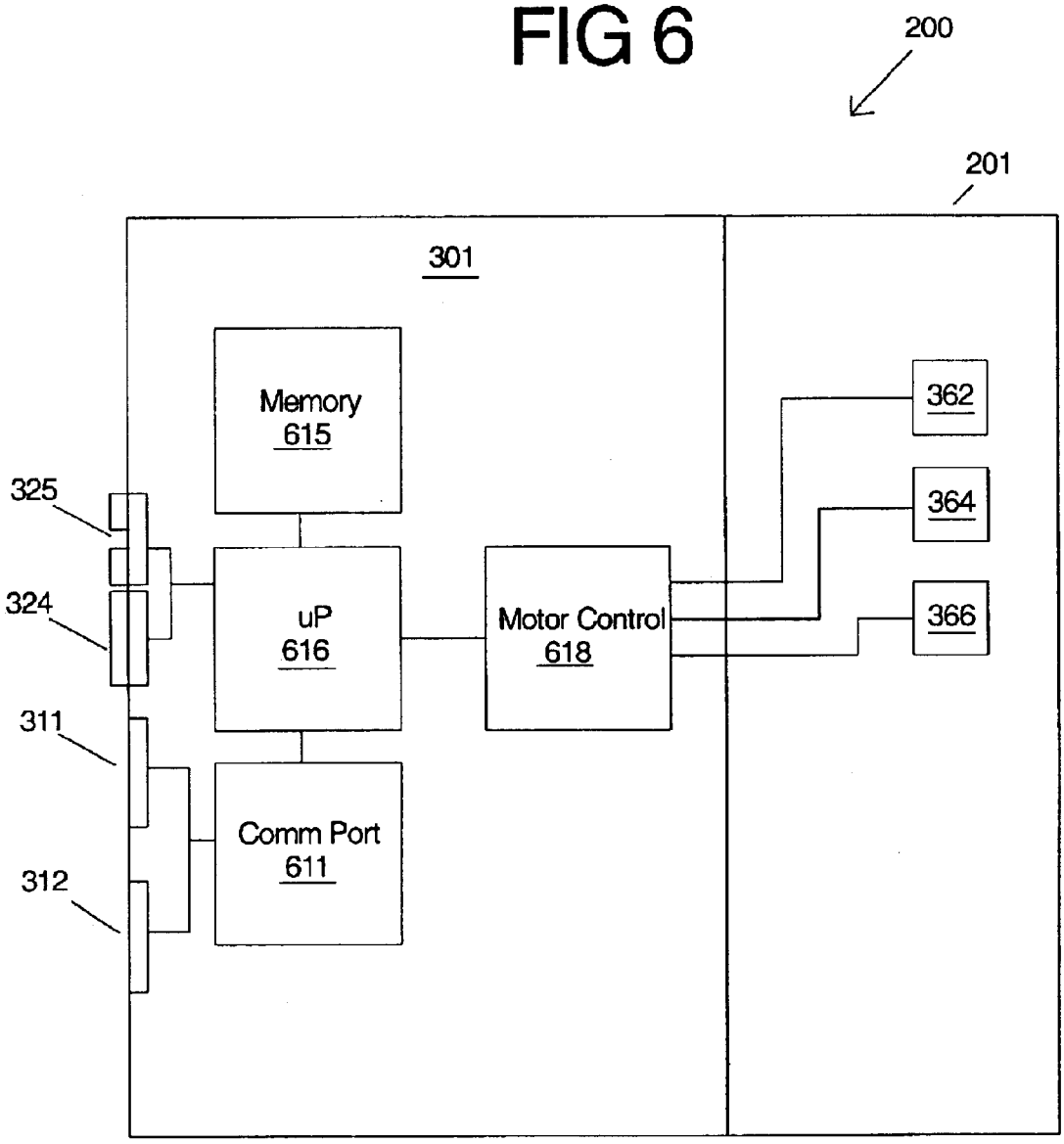
FIG. 6 is a block diagram of one embodiment of an electrical system for operating a color changing apparatus.

FIG. 6 shows the color changing apparatus of FIG. 2 but with detail applied to the electronic control system 301. The housing 201 houses the electronic control system 301 and the motor actuators 362, 364 and 366. Components 311, 312, 324 and 325 are the same as those shown in FIG. 3A. Power and communications input and output connectors shown as 311 and 312 may connect to a power and communications interface shown as 728 in FIG. 7. The power and input connectors 311 and 312 may be connected in parallel and either may be used as an input or output power and communications connector. The power and input connectors 311 and 312 when connected to the power and communications interface 728 of FIG. 7 can supply power and communications to the communications port 611. Power for the motor actuators 362, 362 and 366 as well as the processor 616, the memory 615 and the motor control interface 618 may also be provided from the power and communications interface 728 of FIG. 7 through the power and communications input and output connectors 311 and 312.

The communications port 611 may be a part of the processor 616. The memory 615 may also be a part of the processor 616. For example, an integrated processor that contains the communications port 611 and the memory 615 may be used as a component of the electronic control system 301. The memory 615 may contain an operating address that can be entered by a theatrical technician by using the input switch array 325. Alternatively, the operating address can be stored as a value setting of the input switch array itself. In either case, the color changing apparatus 200 should have an operating address that is unique so that a plurality of color changing apparatus similar to 200 can receive commands separately and each color changing apparatus can act on commands that are unique to a particular color changing apparatus.

Figure 7:
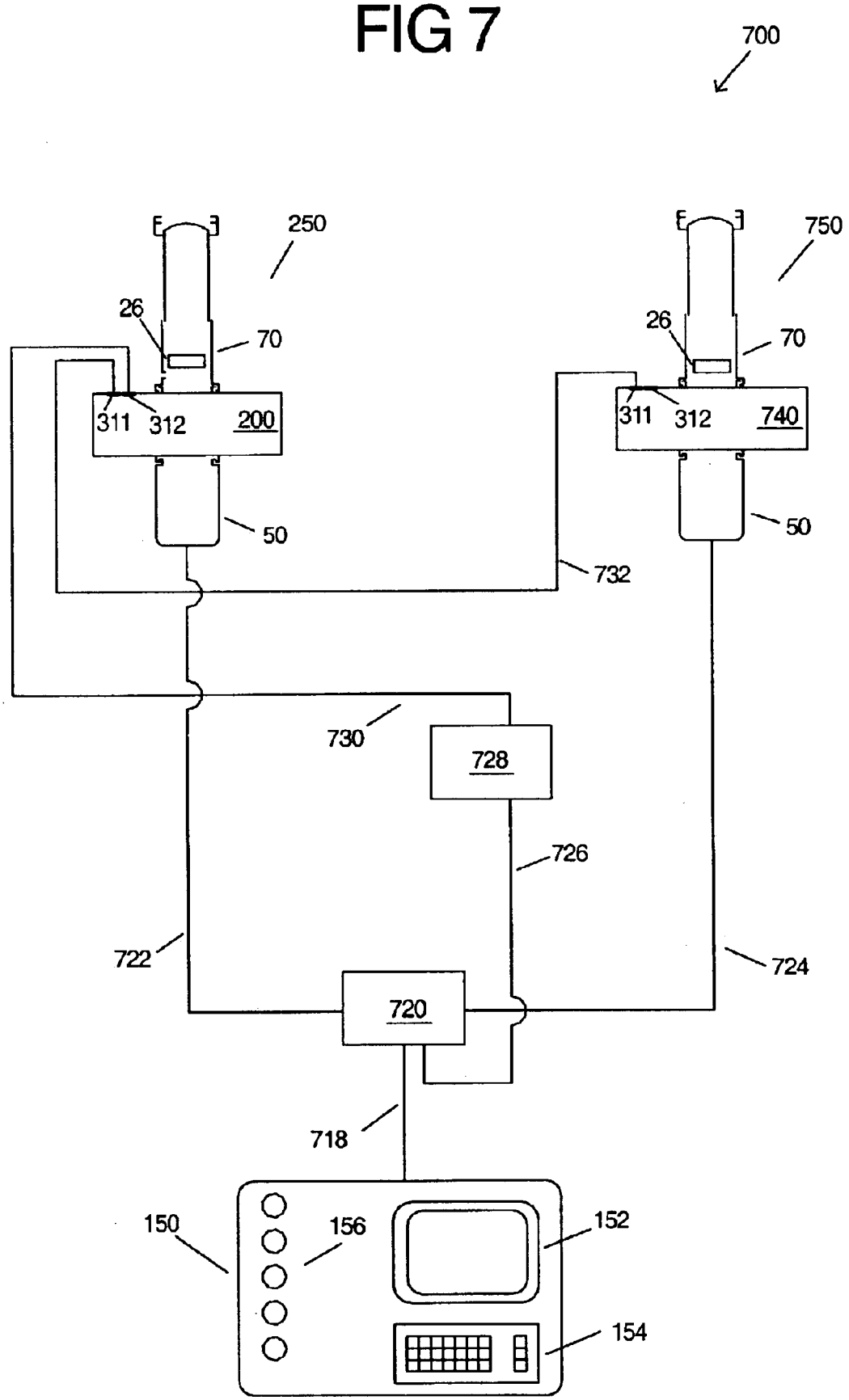
FIG. 7 is a schematic view of a theatrical lighting system incorporating two color changing apparatus.

FIG. 7 shows a theatrical lighting system 700 incorporating the color changing apparatus 200. Improved theatrical spotlight 250 is the same as theatrical spotlight 250 of FIG. 2 and has the color changing apparatus 200 conjoined with the reflector housing 50 and the front barrel housing 70. Improved theatrical spotlight 750 of FIG. 7 has the color changing apparatus 740 conjoined with the reflector housing 50 and the front barrel housing 70. The color changing apparatus 740 is the same as color changing apparatus 200. The improved theatrical ellipsoidal spotlights 250 and 750 have a pattern gate 26 that is the same as the pattern gate 26 of FIG. 1. The pattern gate allows a theatrical lighting designer to install stenciled images or slides into the pattern gate 26 from the exterior of the front barrel housing to be focused upon by the input lens 42 and then projected by the output lens 44 as an image onto the stage.

Theatrical spotlight 250 of FIG. 7 has the lamp 16 contained at least in part of the reflector housing 50 connected to a dimmer cable 722 so that power to the lamp can be controlled. Theatrical spotlight 750 has its lamp contained within the lamp housing 50 and connected to an additional dimmer cable 724 so that power to the lamp can be controlled. The dimmer cables 722 and 724 supply variable power to the lamps located in the reflector housing 50 of theatrical spotlights 250 and 750 from a theatrical dimmer pack 720. Theatrical dimmer packs are known in the prior art for supplying variable power to the lamps of theatrical ellipsoidal spotlights based upon commands received by the theatrical dimmer pack 720 over a communications system from a central controller such as central controller 150.

Commands and address signals are sent from the central controller 150 to the theatrical dimmer pack 720 over communications cable 718. The command and address signals from the central controller 150 are then passed on by the theatrical dimmer pack 720 to the power and communications interface 728 by communications cable 726. The power and communications interface 728 receives address and command signals from the central controller 150 over cable 726. The power and communications interface 728 may process the command and address signals and sends power, command and address signals to the color changing apparatus 200 and 740 over power and communications cables 730. The power and communications cable 730 is connected to connector 312 of the color changing apparatus 200.

A power and communications cable 732 is connected to connector 312 of color changing apparatus 200 and is routed to connector 311 color changing apparatus 740 so that power and communication can be received. The power and communications interface 728 is connected to an exterior source of power not shown. The central controller 150 may contain a visual display 152 that may be a video monitor, a keyboard entry system 154 and input devices 156.

During operation of the theatrical lighting system 700, an operator of the central controller 150 may wish to adjust the color of light projected by a particular ellipsoidal spotlight. The operator may first enter the operating address of the color changing apparatus of the particular ellipsoidal the operator wishes to control. If the operator wishes to control the color of the light projected by the ellipsoidal spotlight 250, the operator first enters the operating address of the color changing apparatus 200 by inputting the appropriate operating address into the keyboard entry system 154. The operating address of the color changing apparatus 200 associated with ellipsoidal spotlight 250 is received by the power and communications interface 728 and is routed to the color changing apparatus 200. The color changing apparatus 200 receives the operating address at the communications port 611. The communications port 611 of FIG. 6 passes the received operating address to the processor 616 where it is compared to the stored operating address.

If the received operating address and the stored operating address match, then the color changing apparatus 200 is ready to act on a command sent from the central controller 150. Next, the operator sends a color changing command from the central controller 150 to the color changing apparatus 200. The color changing command is received by the communications port 611 of FIG. 6 and acted upon by the processor 616 in accordance with operational code stored in the memory 615. The processor 616 acting in accordance with the memory 615 sends control signals to the motor control interface 618 to control the motor actuators 362, 364 or 366 to incrementally transport the color filters 202*c*, 204*c*, 202*m*, 204*m*, 202*y* and 204*y* into the light path.

A color changing command for the cyan color may cause the cyan color filters 202*c* and 204*c* to be transported by the motor actuator 362 to intersect the light path at a point where the light path is 50 percent saturated with cyan color. Another example of a color changing command might affect the magenta color filters 202*m* and 204*m* to be transported by the motor actuator 364 into the light path at a point where the light path is 100% saturated with magenta color. Various color changing command values allow the operator of the central controller 150 to vary the saturation of the cyan, magenta and yellow colors of the light projected incrementally upon the stage by the ellipsoidal spotlight 250.

The operator of the central controller 150 may next wish to adjust the color of the improved ellipsoidal spotlight 750. By entering the proper operating address of the color changing apparatus 740 into the central controller 150, the operator may next send color changing commands to the color changing apparatus 740 to incrementally vary the saturation of the cyan, magenta, and yellow colors of the light projected by the ellipsoidal spotlight 750. A single command may be sent from the central controller 150 to be received by the communications port 611 of FIG. 6 of color changing apparatus 740 that causes the transport of all color filters out of the light path and insures that white light is projected upon the stage (not shown).

An improved color changing apparatus has been disclosed that conjoins with a lamp housing of a theatrical ellipsoidal spotlight. The improved color changing apparatus also conjoins with a front barrel housing of a theatrical ellipsoidal spotlight. The improved color changing apparatus can easily be retrofitted to theatrical ellipsoidal already used in theatre shows. The improved color changing apparatus allows remote controlled varying of the color of light projected by the ellipsoidal spotlight. Dichroic filters are used instead of gels so that the color filters do not fade or distort.

While a preferred embodiment of the invention has been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A color changing apparatus for a theatrical ellipsoidal spotlight having a reflector housing and a front barrel housing, said color changing apparatus comprising:

a color changing housing having first and second sides;

a first fastening system for releasably joining the first side of said color changing housing to the reflector housing of the theatrical ellipsoidal spotlight, wherein the reflector housing comprises a lamp operable to create a light path;

a second fastening system for releasably joining the second side of the color changing housing to the front barrel housing of the theatrical ellipsoidal spotlight, wherein the front barrel housing comprises a lens operable to collect and direct the light path; and a plurality of color filters contained at least in part within the color changing housings, wherein the light path passes through at least one of said plurality of color filters before being collected by the lens.

2. The color changing apparatus of claim 1 wherein said color filters are dichroic color filters.

3. The color changing apparatus of claim 1 wherein said plurality of color filters are serially arranged and comprise filters that are cyan, magenta, and yellow.

4. The color changing apparatus of claim 3 wherein at least two of said plurality of color filters are substantially the same color.

5. The color changing apparatus of claim 1 wherein one or more of said plurality of color filters are adapted to be transported by an actuator to be into or out of the light path that is created by the reflector of the ellipsoidal spotlight.

6. A color changing apparatus for a theatrical ellipsoidal spotlight comprising:

an intermediate housing releasably joining a reflector housing and a front barrel housing of the theatrical ellipsoidal spotlight, wherein light is projected from a lamp disposed in the reflector housing along a path from the reflector housing, through said intermediate housing and through a lens disposed in the front barrel housing;

a plurality of dichroic color filters disposed within said intermediate housing, wherein at least one of said plurality of dichroic filters has a variable density pattern; and a control system including a plurality of actuators and a communications port, wherein said control system is adapted to adjust the position of said plurality of dichroic filters.

7. The color changing apparatus of claim 6 wherein said plurality of dichroic filters include cyan, magenta, and yellow dichroic filters.

8. The color changing apparatus of claim 7 wherein the communications port is connected to at least one external connector adapted to relay both power and communications.

9. The color changing apparatus of claim 6 wherein a first dichroic filter is transportable into and out of the path of the light by a first actuator.

10. The color changing apparatus of claim 9 wherein a second dichroic filter is transportable into and out of the path of the light by a second actuator.

11. A color changing apparatus for a theatrical ellipsoidal spotlight comprising:

an intermediate housing joining a reflector housing and a front barrel housing of the theatrical ellipsoidal spotlight, wherein light is projected along a path from the reflector housing, through said intermediate housing and through the front barrel housing;

a plurality of dichroic color filters disposed within said intermediate housing, wherein at least one of said plurality of dichroic filters has a variable density pattern; and a control system including a plurality of actuators and a communications port, wherein said control system is adapted to adjust the position of said plurality of dichroic filters, wherein a first dichroic filter is transportable into and out of the path of the light by a first actuator, and wherein a second dichroic filter is transportable into and out of the path of the light by a second actuator wherein the communications port receives a command and said control system acts on the command to control the second actuator so as to transport the second dichroic filter into the light path.

12. A color changing apparatus for a theatrical ellipsoidal spotlight comprising:

an intermediate housing joining a reflector housing and a front barrel housing of the theatrical ellipsoidal spotlight, wherein light is projected along a path from the reflector housing, through said intermediate housing and through the front barrel housing;

a plurality of dichroic color filters disposed within said intermediate housing, wherein at least one of said plurality of dichroic filters has a variable density pattern; and a control system including a plurality of actuators and a communications port, wherein said control system is adapted to adjust the position of said plurality of dichroic filters, wherein a first dichroic filter is transportable into and out of the path of the light by a first actuator, and wherein a second dichroic filter is transportable into and out of the path of the light by a second actuator wherein the communications port receives a command that causes all of said plurality of dichroic filters to be removed from the light path.

13. A theatrical lighting system comprising:

a first theatrical ellipsoidal spotlight containing a first pattern gate, a first color changing apparatus, a first reflector housing and a first front barrel housing, wherein the first color changing apparatus is conjoined with the first reflector housing and the first front barrel housing, and wherein the first color changing apparatus comprises a first plurality of dichroic filters that are serially arranged between the first reflector housing and the first front barrel housing such that a first light path generated by a lamp disposed in the first reflector housing passes through the first color changing apparatus before passing through a first lens disposed in the first front barrel housing;

a first control system, including a first communications port, connected to the first color changing apparatus, wherein the first communications port is adapted to receive a first command signal to cause the first plurality of dichroic filters to be transported into the first light path;

a second theatrical ellipsoidal spotlight containing a second pattern gate, a second color changing apparatus, a second reflector housing and a second front barrel housing, wherein the second color changing apparatus is conjoined with the second reflector housing and the second front barrel housing, and wherein the second color changing apparatus comprises a second plurality of dichroic filters that are serially arranged between the second reflector housing and the second front barrel housing such that a second light path generated by a lamp disposed in the second reflector housing passes through the second color changing apparatus before passing through a second lens disposed in the second front barrel housing; and a second control system, including a second communications port, connected to the second color changing apparatus, wherein the second communications port is adapted to receive a second command signal to cause the second plurality of dichroic filters to be transported into the second light path.

14. The theatrical lighting system of claim 13 wherein the first control system is operable to respond to the first command signal received by the first communications port after receiving a first operating address and the second control system is operable to respond to the second command signal received by the second communications port after receiving a second operating address and wherein the first operating address and the second operating address are different operating addresses.

15. The theatrical lighting system of claim 13 wherein the first plurality of dichroic filters of the first color changing apparatus is comprised of a least six dichroic filters having colors of cyan, yellow and magenta and the second plurality of dichroic filters of the second color changing apparatus is comprised of at least six dichroic filters having colors of cyan, yellow and magenta.

16. A method for projecting light on a surface comprising:

providing a plurality of color filters disposed within an intermediate housing;

installing the intermediate housing in a theatrical ellipsoidal spotlight comprising a pattern gate, the intermediate housing being installed between a reflector housing and a front barrel housing;

forming a light path that runs from the reflector housing, through the intermediate housing, and through a lens disposed within the front barrel housing; and projecting light from a lamp disposed in the reflector housing along the light path and onto the surface.

17. The method of claim 16 further comprising transporting at least one of the plurality of color filters into the light path.

18. The method of claim 17 wherein at least one color filter is transported by an actuator.

19. The method of claim 16 wherein the plurality of color filters are dichroic color filters.

20. The method of claim 16 wherein the plurality of color filters are serially arranged and comprise filters that are cyan, magenta, and yellow.

21. The method of claim 20 wherein at least two of the plurality of color filters are the same color.

22. A method for controlling light projected onto a surface comprising:

providing a plurality of color filters disposed within an intermediate housing that is installed between a reflector housing and a front barrel housing of a theatrical ellipsoidal spotlight;

establishing a light path that runs from a lamp disposed within the reflector housing, through the intermediate housing, and into a lens disposed in the front barrel housing;

connecting a plurality of actuators to the plurality of color filters, wherein the plurality of actuators are adapted to transport each of said plurality of color filters into and out of the light path; and transmitting a command to a control system causing one of the plurality of actuators to transport one of the plurality of color filters into the light path.

23. The method of claim 22 wherein the plurality of color filters are dichroic color filters.

24. The method of claim 23 wherein the dichroic color filters have a variable density pattern.

25. The method of claim 23 wherein a first dichroic filter has a first variable density pattern and a second dichroic filter has a second variable density pattern and the first variable density pattern is a different pattern than the second variable density pattern.

26. The method of claim 22 wherein the plurality of color filters are serially arranged and comprise filters that are cyan, magenta, and yellow.

27. The method of claim 26 wherein at least two of the plurality of color filters are the same color.

28. A method for controlling light projected onto a surface comprising:

providing a plurality of color filters disposed within an intermediate housing that are installed between a reflector housing and a front barrel housing of a theatrical ellipsoidal spotlight;

establishing a light path that runs from the reflector housing, through the intermediate housing, and into the front barrel housing;

connecting a plurality of actuators to the plurality of color filters, wherein the plurality of actuators are adapted to transport each of said plurality of color filters into and out of the light path; and transmitting a first command to a control system causing one of the plurality of actuators to transport one of the plurality of color filters into the light path; and transmitting a second command to the control system causing a second of the plurality of actuators to transport a second of the plurality of color filters into the light path.

29. A color changing apparatus for a theatrical ellipsoidal spotlight said theatrical ellipsoidal spotlight comprising:

a reflector housing comprising a lamp operable to generate a path of light and a reflector housing fastening system;

a front barrel housing comprising a lens operable to collect and direct the path of light from the reflector housing and a front barrel housing fastening system;

wherein the reflector housing fastening system is operable to releasably connect with the front barrel housing fastening system in order to conjoin the reflector housing with the front barrel housing;

wherein the conjoining of the front barrel housing with the reflector housing allows the light path generated by the reflector housing to be collected and directed by the front barrel housing in the absence of the color changing apparatus;

the color changing apparatus comprising;

a color changing housing having a first side and a second side;

a plurality of serially arranged dichroic color filters;

the first side of the color changing housing comprising a first side fastening system that is operable to releasably connect with the reflector housing fastening system in order to conjoin the first side of the color changing housing to the reflector housing;

the second side of the color changing housing comprising a second side fastening system operable to releasably connect with the front barrel housing fastening system in order to conjoin the second side of the color changing housing to the front barrel housing;

wherein the color changing apparatus can simultaneously conjoin the first side of the color changing housing with the reflector housing and the second side of the color changing housing to the front barrel housing;

wherein a plurality of serially arranged dichroic color filters are contained at least in part within the color changing housing; and wherein the path of the light from the reflector housing can pass through at least one of said plurality of serially arranged dichroic color filters before being collected and directed by the front barrel housing.

30. The color changing apparatus of claim 29 wherein the plurality of serial arranged dichroic color filters include cyan, magenta, and yellow color filters.

31. The color changing apparatus of claim 30 wherein the cyan, magenta and yellow color filters are variable density color filters.

32. The color changing apparatus of claim 31 wherein at least two of said plurality of serially arranged color filters are substantially the same color.

33. The color changing apparatus of claim 29 further comprising a plurality of actuators, wherein the plurality of serially arranged dichroic color filters are adapted to be transported by the plurality of actuators into the path of light.

34. The color changing apparatus of claim 33 further comprising a control system.

35. The color changing apparatus of claim 34 further comprising a communications port adapted to receive commands and wherein the communications port receives a first command and said control system acts on the first command to control a first actuator to incrementally transport a first dichroic color filter into the path of light; and wherein the communications port receives a second command and said control system acts on the second command to control a second actuator to incrementally transport a second dichroic color filter into the path of light.

* * * * *